US007624938B2

(12) United States Patent
Aries et al.

(10) Patent No.: US 7,624,938 B2
(45) Date of Patent: Dec. 1, 2009

(54) SHREDDING MACHINE

(75) Inventors: Paul Arthur Aries, West Midlands (GB); Michael David Sawford, Bucks (GB); Ian Stuart Smith, Northants (GB)

(73) Assignee: ACCO UK Limited, Aylesbury (GB)

( * ) Notice: Subject to any disclaimer, the term of this patent is extended or adjusted under 35 U.S.C. 154(b) by 57 days.

(21) Appl. No.: 11/561,022

(22) Filed: Nov. 17, 2006

(65) Prior Publication Data

US 2007/0246582 A1 Oct. 25, 2007

(30) Foreign Application Priority Data

Apr. 24, 2006 (GB) ..... 0608072.5

(51) Int. Cl.
*B02C 25/00* (2006.01)

(52) U.S. Cl. ..... 241/36; 241/37.5; 241/236

(58) Field of Classification Search ..... 241/30, 241/37.5, 36, 236, 100
See application file for complete search history.

(56) References Cited

U.S. PATENT DOCUMENTS

| | | | |
|---|---|---|---|
| 3,619,537 | A | 11/1971 | Nara et al. |
| 3,724,766 | A | 4/1973 | Bosland |
| 3,764,819 | A | 10/1973 | Muller |
| 3,829,850 | A | 8/1974 | Guetersloh |
| 3,947,734 | A | 3/1976 | Fyler |
| 4,352,980 | A | 10/1982 | Hibari |
| 4,489,897 | A | 12/1984 | Turner et al. |
| 4,497,478 | A | 2/1985 | Reschenhofer et al. |
| 4,683,381 | A | 7/1987 | Dufoug |
| 4,707,704 | A | 11/1987 | Allen et al. |
| 4,842,205 | A | 6/1989 | Araki |

(Continued)

FOREIGN PATENT DOCUMENTS

| | | |
|---|---|---|
| DE | 3313232 | 10/1984 |

(Continued)

OTHER PUBLICATIONS

International Search Report and Written Opinion for PCT/US2005/028290 dated Nov. 21, 2005.

(Continued)

*Primary Examiner*—Mark Rosenbaum
(74) *Attorney, Agent, or Firm*—Michael Best & Friedrich LLP

(57) ABSTRACT

A shredding machine is disclosed which is particularly suitable for domestic or office use in shredding papers or the like. The machine comprises a feed aperture arranged above an electric cutting mechanism, the feed aperture preferably taking the form of a feed slot. The machine is characterised by the provision of an actuating element which is moveable, preferably in a pivotal manner, between a first position in which the actuating element permits energisation of the cutting mechanism, and a second position in which the actuating element prevents energisation of the cutting mechanism. The arrangement is such that the actuating element extends into the feed slot and is configured such that the part of the element extending into the feed slot will be engaged by sheet material inserted into the feed slot if the sheet material exceeds a predetermined thickness, said engagement thus being effective to move the actuating element from the first position to the second position to prevent energisation of the cutting mechanism.

27 Claims, 9 Drawing Sheets

U.S. PATENT DOCUMENTS

| | | | | |
|---|---|---|---|---|
| 5,017,972 | A | 5/1991 | Daughton et al. | |
| 5,081,406 | A | 1/1992 | Hughes et al. | |
| 5,166,679 | A | 11/1992 | Vranish et al. | |
| 5,186,398 | A | 2/1993 | Vigneau, Jr. | |
| 5,342,033 | A | 8/1994 | Iwata et al. | |
| 5,345,138 | A | 9/1994 | Mukaidono et al. | |
| 5,397,890 | A | 3/1995 | Schueler et al. | |
| 5,415,355 | A | 5/1995 | Gollwitzer | |
| 5,429,313 | A | 7/1995 | Schwelling et al. | |
| 5,494,229 | A | 2/1996 | Rokos | |
| 5,775,605 | A | 7/1998 | Tsai | |
| 5,823,529 | A | 10/1998 | Mandel et al. | |
| 5,850,342 | A | 12/1998 | Nakamura et al. | |
| 5,924,637 | A | 7/1999 | Niederholtmeyer | |
| D412,716 | S | 8/1999 | Kroger | |
| 5,942,975 | A | 8/1999 | Sorenson | |
| 6,065,696 | A | 5/2000 | Tsai | |
| 6,079,645 | A | 6/2000 | Henreckson | |
| 6,265,682 | B1 | 7/2001 | Lee | |
| 6,376,939 | B1 | 4/2002 | Suzuki et al. | |
| 6,418,004 | B1 | 7/2002 | Mather et al. | |
| 6,550,701 | B1 * | 4/2003 | Chang | 241/36 |
| 6,601,787 | B1 | 8/2003 | Langenecker | |
| 6,655,943 | B1 | 12/2003 | Peterson | |
| 6,676,460 | B1 | 1/2004 | Motsenbocker | |
| 6,698,640 | B2 | 3/2004 | Hakozaki et al. | |
| 6,724,324 | B1 | 4/2004 | Lambert | |
| 6,813,983 | B2 | 11/2004 | Gass et al. | |
| 6,826,988 | B2 | 12/2004 | Gass | |
| 6,857,345 | B2 | 2/2005 | Gass | |
| 6,877,410 | B2 | 4/2005 | Gass et al. | |
| 6,880,440 | B2 | 4/2005 | Gass et al. | |
| 6,920,814 | B2 | 7/2005 | Gass et al. | |
| 6,979,813 | B2 | 12/2005 | Avril | |
| 7,040,559 | B2 | 5/2006 | Matlin | |
| 7,325,757 | B2 | 2/2008 | Allen et al. | |
| 2002/0017175 | A1 | 2/2002 | Gass et al. | |
| 2002/0017176 | A1 | 2/2002 | Gass et al. | |
| 2002/0017178 | A1 | 2/2002 | Gass et al. | |
| 2002/0017179 | A1 | 2/2002 | Gass et al. | |
| 2002/0017180 | A1 | 2/2002 | Gass et al. | |
| 2002/0017181 | A1 | 2/2002 | Gass et al. | |
| 2002/0017182 | A1 | 2/2002 | Gass et al. | |
| 2002/0017184 | A1 | 2/2002 | Gass et al. | |
| 2002/0017336 | A1 | 2/2002 | Gass et al. | |
| 2002/0020261 | A1 | 2/2002 | Gass et al. | |
| 2002/0020262 | A1 | 2/2002 | Gass et al. | |
| 2002/0020263 | A1 | 2/2002 | Gass et al. | |
| 2002/0020265 | A1 | 2/2002 | Gass et al. | |
| 2002/0020271 | A1 | 2/2002 | Gass et al. | |
| 2002/0056348 | A1 | 5/2002 | Gass et al. | |
| 2002/0056349 | A1 | 5/2002 | Gass et al. | |
| 2002/0056350 | A1 | 5/2002 | Gass et al. | |
| 2002/0059853 | A1 | 5/2002 | Gass et al. | |
| 2002/0059854 | A1 | 5/2002 | Gass et al. | |
| 2002/0059855 | A1 | 5/2002 | Gass et al. | |
| 2002/0066346 | A1 | 6/2002 | Gass et al. | |
| 2002/0069734 | A1 | 6/2002 | Gass et al. | |
| 2002/0170399 | A1 | 11/2002 | Gass et al. | |
| 2002/0170400 | A1 | 11/2002 | Gass | |
| 2002/0190581 | A1 | 12/2002 | Gass et al. | |
| 2003/0002942 | A1 | 1/2003 | Gass et al. | |
| 2003/0005588 | A1 | 1/2003 | Gass et al. | |
| 2003/0015253 | A1 | 1/2003 | Gass et al. | |
| 2003/0019341 | A1 | 1/2003 | Gass et al. | |
| 2003/0020336 | A1 | 1/2003 | Gass et al. | |
| 2003/0037651 | A1 | 2/2003 | Gass et al. | |
| 2003/0056853 | A1 | 3/2003 | Gass et al. | |
| 2003/0058121 | A1 | 3/2003 | Gass et al. | |
| 2003/0090224 | A1 | 5/2003 | Gass et al. | |
| 2003/0131703 | A1 | 7/2003 | Gass et al. | |
| 2003/0140749 | A1 | 7/2003 | Gass et al. | |
| 2003/0196824 | A1 | 10/2003 | Gass et al. | |
| 2004/0008122 | A1 | 1/2004 | Michael | |
| 2004/0040426 | A1 | 3/2004 | Gass et al. | |
| 2004/0163514 | A1 | 8/2004 | Gass et al. | |
| 2004/0173430 | A1 | 9/2004 | Gass | |
| 2004/0194594 | A1 | 10/2004 | Dils et al. | |
| 2004/0226800 | A1 | 11/2004 | Pierga et al. | |
| 2005/0039586 | A1 | 2/2005 | Gass et al. | |
| 2005/0039822 | A1 | 2/2005 | Gass et al. | |
| 2005/0041359 | A1 | 2/2005 | Gass | |
| 2005/0066784 | A1 | 3/2005 | Gass | |
| 2005/0103510 | A1 | 5/2005 | Gass et al. | |
| 2005/0139051 | A1 | 6/2005 | Gass et al. | |
| 2005/0139056 | A1 | 6/2005 | Gass et al. | |
| 2005/0139057 | A1 | 6/2005 | Gass et al. | |
| 2005/0139058 | A1 | 6/2005 | Gass et al. | |
| 2005/0139459 | A1 | 6/2005 | Gass et al. | |
| 2005/0150986 | A1 | 7/2005 | Castronovo | |
| 2005/0155473 | A1 | 7/2005 | Gass | |
| 2005/0166736 | A1 | 8/2005 | Gass et al. | |
| 2005/0263630 | A1 | 12/2005 | Zhang et al. | |
| 2006/0016919 | A1 | 1/2006 | Castronovo | |
| 2006/0054724 | A1 | 3/2006 | Matlin et al. | |
| 2006/0054725 | A1 | 3/2006 | Matlin | |
| 2006/0091247 | A1 | 5/2006 | Matlin | |
| 2006/0219827 | A1 | 10/2006 | Matlin et al. | |
| 2007/0164135 | A1 | 7/2007 | Zhong | |
| 2007/0215728 | A1 | 9/2007 | Priester | |
| 2007/0221767 | A1 | 9/2007 | Matlin | |

FOREIGN PATENT DOCUMENTS

| | | | |
|---|---|---|---|
| DE | 8619856.4 | G | 9/1988 |
| DE | 4121330 | A1 | 1/1993 |
| DE | 19835093 | A1 | 2/1999 |
| DE | 102006036136 | | 1/2008 |
| EP | 855221 | | 7/1988 |
| GB | 1199903 | A | 7/1970 |
| GB | 2171029 | A | 8/1986 |
| GB | 2440651 | | 6/2008 |
| JP | 5211691 | | 1/1977 |
| JP | 5776734 | | 1/1982 |
| JP | 4157093 | | 5/1992 |
| JP | 4180852 | | 6/1992 |
| JP | 6277548 | A | 10/1994 |
| JP | 7299377 | | 11/1995 |
| JP | 9262491 | | 10/1997 |
| JP | 11216383 | | 8/1999 |
| JP | 20000346288 | | 12/2000 |
| JP | 2002239405 | A | 8/2002 |
| JP | 2004321993 | | 11/2004 |
| WO | 2005070553 | | 8/2005 |
| WO | WO 2006/031324 | | 3/2006 |
| WO | 2007109753 | | 9/2007 |

OTHER PUBLICATIONS

International Search Report for PCT/GB2006/004286 dated Jan. 31, 2007.

United Kingdom Search Report and Examination Opinion for GB0608072.5 dated Aug. 9, 2007.

U.S. Appl. No. 11/385,864, filed Sep. 2007, Matlin.

Preliminary Amendments filed Aug. 7, 2008 and Sep. 10, 2008 in U.S. Appl. No. 11/444,491.

Manual Translation of Japanese application 2002-239405, published Aug. 27, 2002.

Office Action dated May 26, 2009 in U.S. Appl. No. 11/444,491.

Manual Translation of Japanese Unexamined Patent Application Publication No. 2004-321993, published Nov. 18, 2004.

* cited by examiner

SHREDDING MACHINE

THE PRESENT INVENTION relates to a shredding machine and more particularly to a shredding machine for shredding sheet material. Most preferably, the present invention relates to a shredding machine in the form of a paper-shredder suitable for home or office use.

Over recent years it has been customary to provide shredding machines in domestic homes or work places such as offices, in order to provide a convenient method of securely disposing of confidential documentation or other sensitive papers.

Conventional paper shredders of the type mentioned above are provided with a paper feed-aperture, particularly in the form of a feed-slot of elongate form, through which a plurality of paper sheets or the like can be fed towards a pair or rotating cutters located below the feed-slot which serve to shred the paper sheets into a plurality of strips having a width of only a few millimeters, the resulting strips of paper being collected in a basket or bin located below the cutters. For reasons of space and economy, the cutting mechanisms used in conventional paper shredders of this type are only effective in shredding stacks of paper or card up to a relatively small predetermined thickness. If a stack of papers or cards exceeding this predetermined thickness is inserted into the feed-slot, for example by being force-fed into the slot by an over-enthusiastic user, it is possible to present the shredding mechanism with such a bulk of material so as to overload the mechanism and stall the driving motor or otherwise jam the mechanism. Not only can paper-jams of this type represent an annoyance to a person using the paper shredder, but they can serve to damage the cutting mechanism, for example by distorting the shafts of the cutters or damaging the cutting blades.

It is desirable to provide a simple and convenient mechanism to prevent overloading of a paper-shredder by inserting sheet material of too great a thickness in the manner described above.

It is therefore an object of the present invention to provide an improved shredding machine for shredding sheets of material.

Accordingly, the present invention provides a shredding machine for shredding sheet material, the machine comprising a feed-aperture and an electric cutting mechanism, the feed-aperture being configured to receive multiple sheets and direct said sheets towards the cutting mechanism for shredding, the machine being characterised by the provision an actuating element which is moveable between a first position in which the actuating element permits energisation of the cutting mechanism and a second position in which the actuating element prevents energisation of the cutting mechanism, wherein part of the actuating element extends into the feed-aperture, the actuating element being configured such that said part will be engaged by sheet material inserted into the feed-aperture, and moved from said first position to said second position as a result of said engagement, if the sheet material exceeds a predetermined thickness.

Preferably, said actuating element is biased towards said first position.

Conveniently, said bias is provided by a spring.

Advantageously, said actuating element is arranged to actuate a switch when in said second position, the switch being configured to cause a break in the circuit providing power to the cutting mechanism.

Conveniently, said switch comprises a non-contacting sensing means.

Preferably, said switch is a photo-switch.

Conveniently, said switch is a micro-switch.

Advantageously, said actuating element is provided in the form of an elongate arm mounted for pivotal movement between said first and second positions.

Preferably, the extent of the arm extending from the pivot axis of the arm into the feed-aperture is less than the extent of the arm extending from the pivot axis to the switch.

In a preferred embodiment, the actuating element is in the form of a pair of pivotally mounted arm members, the arm members being operably connected to one another by an intermediate gear arrangement for movement of the actuating element between said first and second position.

Conveniently, the shredding machine comprises at least one pair of rollers positioned in between the feed aperture and the cutting mechanism such that sheets being directed towards the cutting mechanism pass between the rollers, upstream of the cutting mechanism.

Conveniently, a pair of said rollers is located adjacent the feed aperture.

In an alternative preferred embodiment, the machine is further provided with a sheet material engaging member positioned downstream of the actuating element, the engaging member being operable to engage and press against the sheet material for preventing the sheet material from subsequently exceeding the predetermined intermediate threshold thickness, downstream of the actuating element.

Preferably, the engaging member is in the form of a motor driven trigger plate for pressing against the sheet material, the trigger plate being operably connected to the respective motor by means of a cam member for advancing the trigger plate towards the sheet material along a direction generally perpendicular to the plane of the sheet material.

Conveniently, the pivot axis is located substantially adjacent the feed-aperture.

Preferably, said switch is located remote from said pivot axis.

Advantageously, said predetermined thickness is less than or equal to the maximum thickness of sheet material which can be shredded by the cutting mechanism without the mechanism becoming jammed.

Conveniently, the shredding machine is further provided with indicating means to provide a visual indication to a user of the machine that energisation of the cutting mechanism is prevented, when the actuating element is in said second position.

Preferably, the shredding machine is provided in the form of a paper-shredder suitable for home or office use.

So that the invention may be more readily understood, and so that further features thereof may be appreciated, an embodiment of the present invention will now be described, by way of example, with reference to the accompanying drawings, in which.

Figure 1:
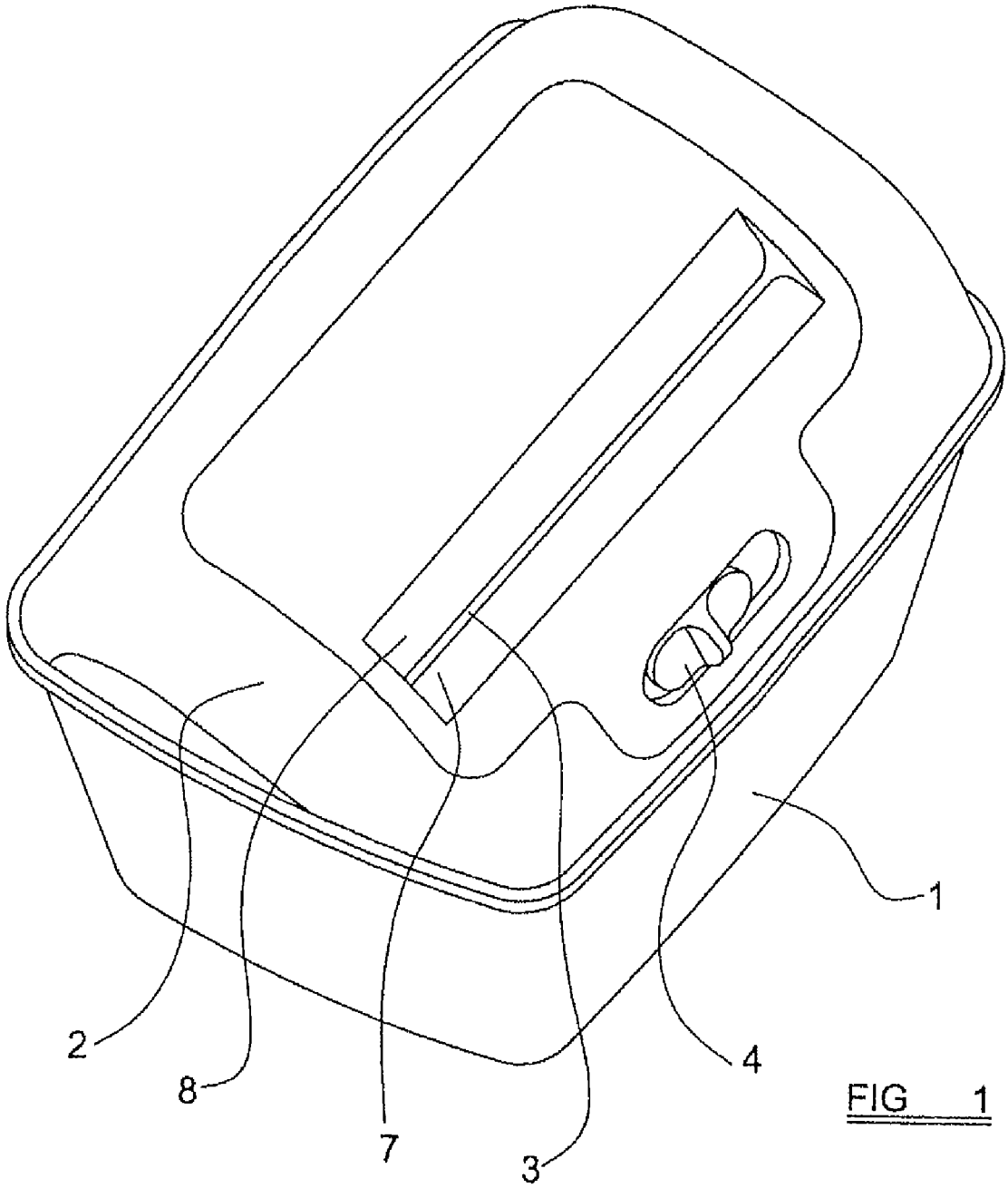
FIG. 1 is a perspective view from above of a shredding machine in accordance with the present invention, taking the form of a paper-shredder for home or office use.

Referring initially to FIG. 1, there is illustrated a shredding machine in accordance with the present invention, provided in the form of a domestic or office paper-shredder. FIG. 1 illustrates the paper-shredder from above.

The shredding machine comprises a relatively large plastic container or bin 1, on top of-which sits a housing 2 inside which the operative parts of the paper shredder are located, as will be described in more detail hereinafter. The housing 2 is provided with a feed aperture 3 which takes the form of an elongate slot having a length sufficient to accommodate sheets of appropriate size to be shredded by the machine. During operation, sheet material to be shredded such as sheets of paper or card or the like, is inserted into the paper feed slot 3 whereupon the sheets are drawn into the shredding mechanism in a manner known per se and shredded into a plurality of strips which then exit the shredding mechanism from the bottom of the housing 2 so as to fall from the housing and be collected in the bin 1 located therebelow.

FIG. 1 also illustrates an operating switch 4 which, in the embodiment illustrated, takes the form of a simple sliding switch. The switch 4 is operable by a person using the shredding machine in order to switch the machine on and off.

The features of the shredding machine described above with reference to FIG. 1 are conventional.

Figure 2:
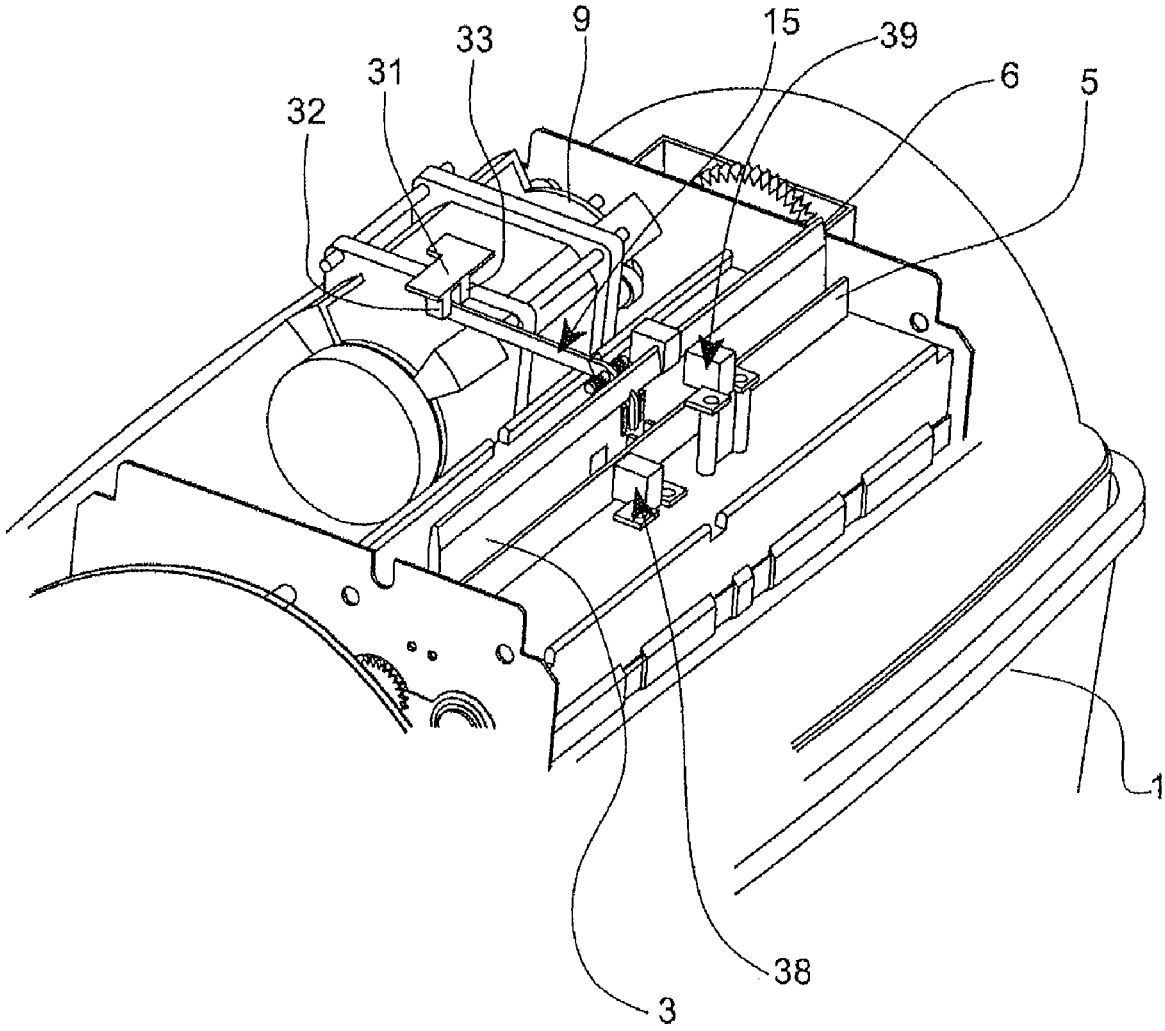
FIG. 2 is a perspective view from above of the paper-shredder of FIG. 1, illustrating the arrangement with a top cover of the machine removed.

FIG. 2 illustrates the internal workings of the shredding machine in more detail, with the upper part of the housing 2 having been removed.

The feed slot 3 is defined, in the absence of the top part of the housing 2, by a pair of substantially parallel upstanding feed walls 5, 6. As can be seen from FIG. 2, in the embodiment illustrated, the upper edge of the front feed wall 5 is located below the level of the upper edge of the rear feed wall 6. The two feed walls 5, 6 are spaced apart from one another by a distance slightly greater than the maximum thickness of sheet material which the shredding machine is capable of shredding, as Will be described in more detail hereinafter.

As will be appreciated from a comparison of FIGS. 1 and 2, when the top part of the housing 2 is placed over the inner workings of the shredding machine, the region of the housing 2 defining the opening to the feed slot 3 is aligned with and overlies the space defined between the feed walls 5, 6. In fact, this region of the upper housing 2 is preferably moulded from the plastics material in such a manner that inwardly-directed lips 7, 8 extend part-way down the inwardly-directed face of respective feed walls 5, 6 so as to define a smooth and uninterrupted opening into the feed slot. This is also illustrated more clearly in FIG. 3.

FIG. 2 also illustrates part of an electric motor 9 which is mounted to the rear of the feed slot 3. The motor 9 is connected, via a gear arrangement, to a pair of elongate rotatable cutters 10, 11 which are arranged for counter-rotation relative to one another in a region below the feed slot 3, as illustrated most clearly in FIG. 3. Each cutter 10,11 is generally cylindrical in form and is provided with a plurality of spaced-apart cutting discs 12 along its length, the cutting discs of one cuter being interposed between those of the other cutter. Hence, in FIG. 3, which is a sectional view taken through the central region of the shredding machine, only one cutting disc 12 is visible. However, it will be seen that this cutting disc is provided with a number of cutting teeth 13 at spaced apart positions around its periphery.

Figure 3:
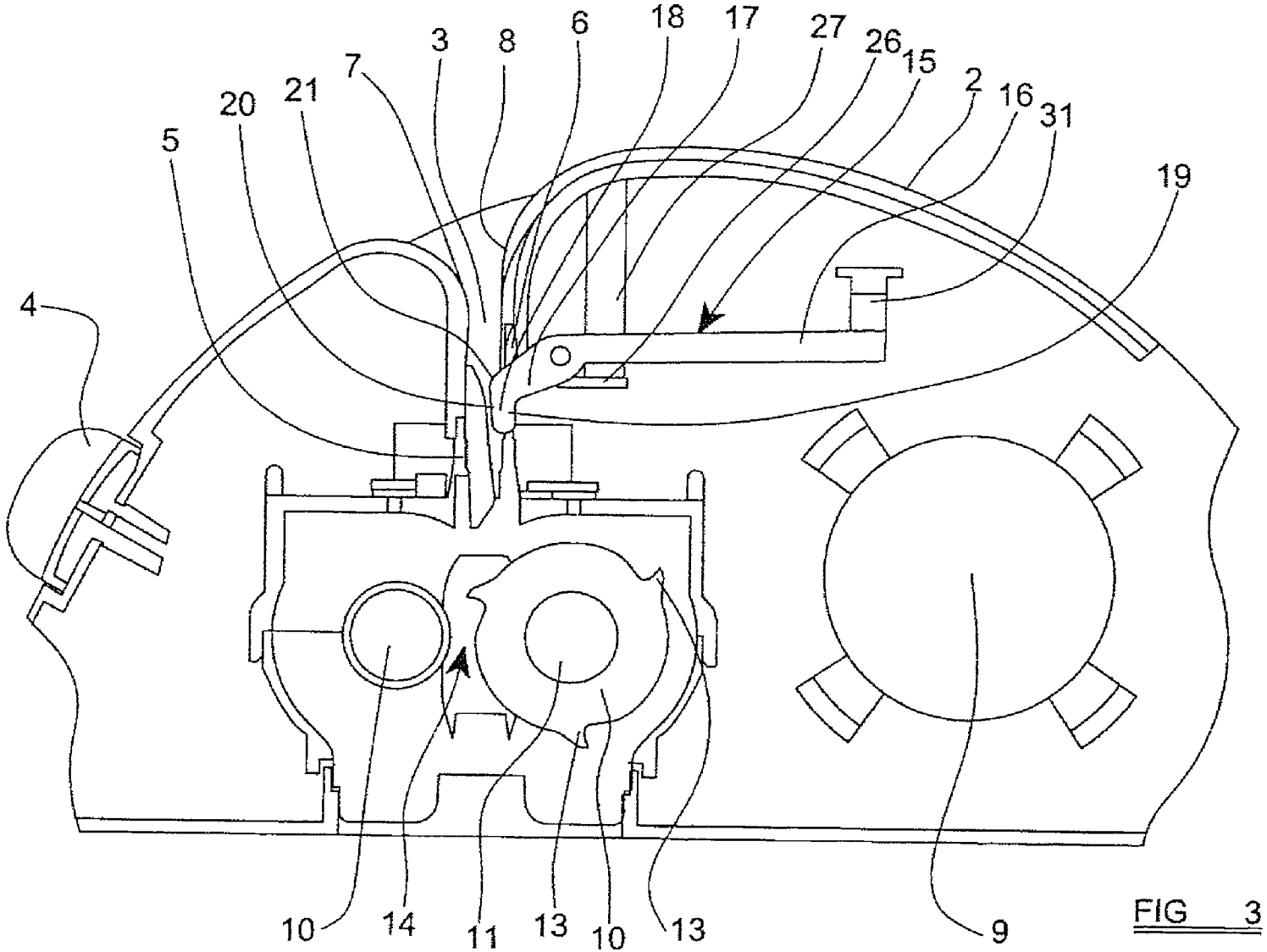
FIG. 3 is a transverse cross-sectional view taken through the middle of the paper-shredder illustrated in FIG. 1, viewed from the right-hand end of the machine as illustrated in FIG. 1.

Upon energisation of the electric motor 9, the two cutters 10, 11 are caused to rotate, such that the forwardmost cutter 10 rotates in a clockwise sense as viewed in FIG. 3, whilst the rearmost cutter 11 rotates in a counter-clockwise sense as viewed in FIG. 3. In this manner, the two cutters 10, 11 are arranged to pull sheet material passing through the feed slot 3, through the nip 14 defined between the two cutters 10, 11.

As also illustrated in FIGS. 2 and 3, an activating element is provided in the form of an elongate actuating arm 15, which extends from the feed slot 3 in a rearwards direction. The actuating arm 15 is of cranked form comprising a relatively long rear finger 16 which supports at its forwardmost end a forwardly and downwardly-extending front finger 17, the upper surface 18 of which is generally linear and, in the orientation of the actuating arm 15 illustrated in FIG. 3, slopes forwardly and downwardly. At its forwardmost end, the front finger 17 carries a downwardly-depending projection 19, the front surface of which defines a generally linear bearing surface 20 which is connected to the upper surface 18 of the front finger 17 by a chamfered corner 21.

Figure 4:
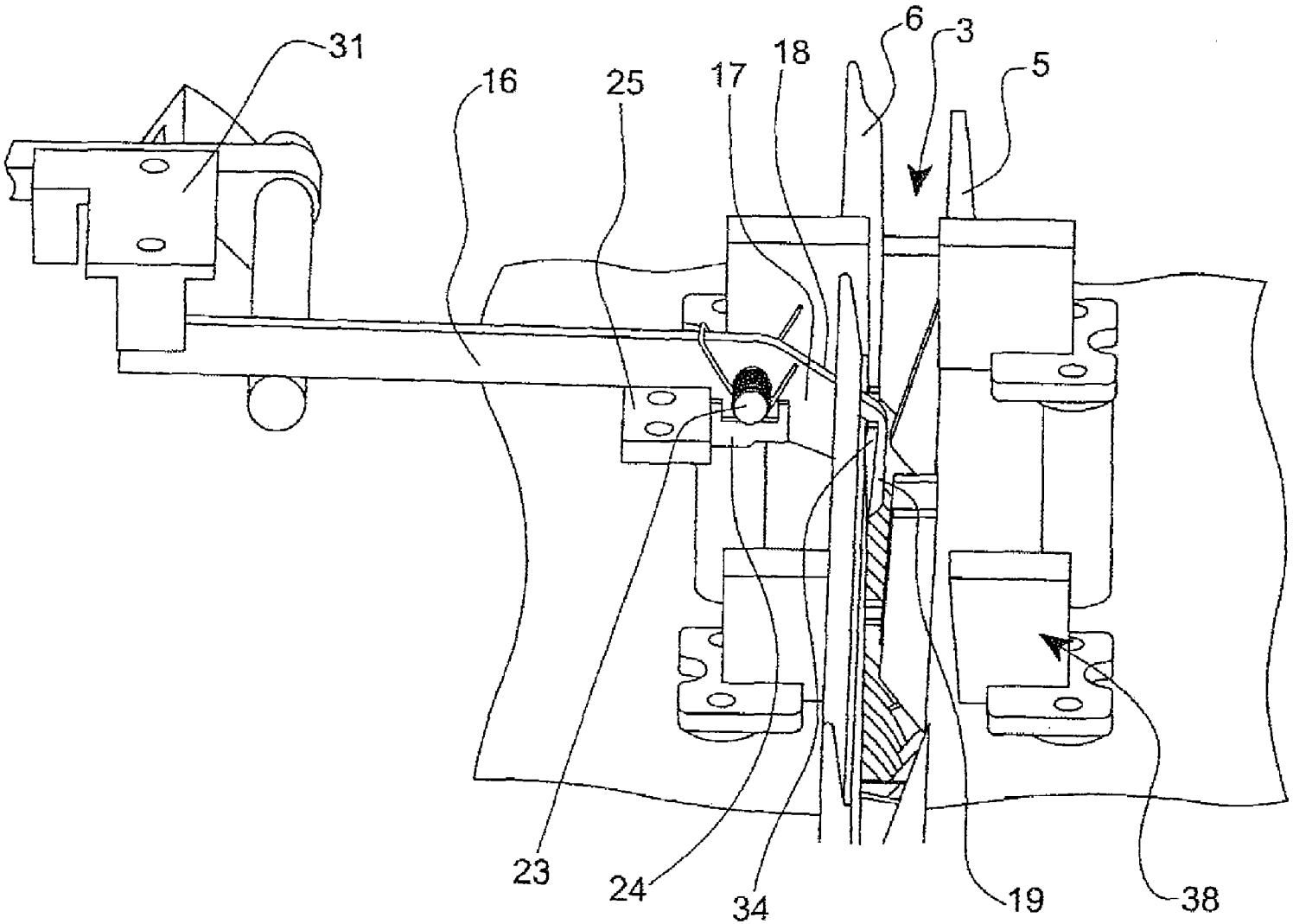
FIG. 4 is an enlarged view of part of the mechanism provided inside the shredding machine.
Figure 5:
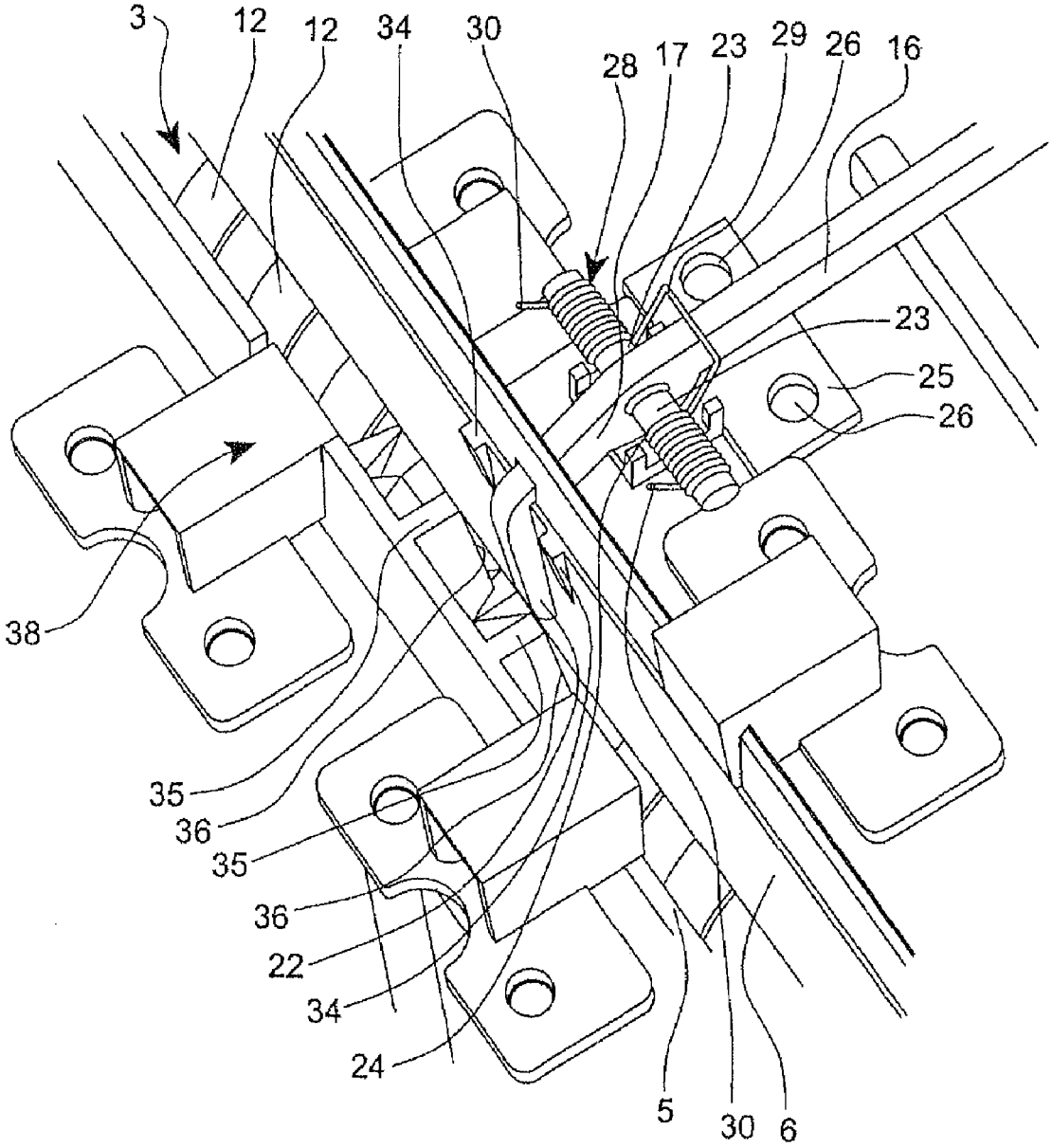
FIG. 5 is an enlarged perspective view, from above and the other side, of the mechanism illustrated in FIG. 4.

As illustrated most clearly in FIGS. 4 and 5 the downwardly-depending projection 19 carried by the front finger 17 is accommodated within a vertically-oriented slot 22 provided through the rear feed wall 6. In this manner, the projection 19 projects partially into the feed slot 3 defined between the rear feed wall 6 and the front feed wall 5.

The actuating arm 15 is provided with a pair of co-aligned outwardly-directed spigots 23 (visible most clearly in FIG. 5), each of which projects outwardly from a respective side of the arm, in the region where the rear finger 16 meets the front finger 17. Each spigot 23 is rotatably mounted on a bearing 24 carried by a support plate 25. The support plate 25 is provided with a pair Of spaced-apart mounting holes 26, each of which serves to mount the support plate to a support structure 27 which extends downwardly from the housing 2, as illustrated in FIG. 3.

By virtue of the rotatable manner in which each spigot 23 sits on its respective bearing 24, it should therefore be appreciated that the actuating arm 15 as a whole is thus pivotally mounted relative to the feed slot 3.

A biasing spring 28 is provided which comprises a pair of spaced-apart helically wound regions, connected by a bridge region 29. Each helically wound region receives a respective spigot 23 therein, and the connecting bridge region 29 bears against the upper surface of the rear finger 16. At the outermost end of each helically wound region of the spring, a respective free end 30 of the spring extends upwardly and forwardly towards the rear feed wall 6. Although not illustrated for the sake of clarity, each free end 30 of the spring serves to bear against a fixed part of the shredding machine's structure. The spring 28 thus serves to bias the actuating arm 15 in a counter-clockwise sense as viewed in FIG. 4 (clockwise as viewed in FIG. 5) so that the undersurface of its rear finger 16 bears against the support plate 25, thereby serving a stop function and defining a first position for the moveable actuating arm 15.

As illustrated most clearly in FIG. 2, the shredding machine is provided with a switch 31 which, as illustrated in FIG. 3, is supported from the housing 2 so as to lie above the rearmost end of the rear finger 16 of the actuating arm 15. In the embodiment illustrated, the switch 31 takes the form of a photo-switch having a light source 32 and a photo-sensor 33 provided in spaced-apart relation above the rear end of the finger 16 when the actuating arm 15 assumes its first position under the biasing action of the spring. The spacing between the light source 32 and the photo-sensor 33 is sufficient to allow the rearmost end of the finger 16 to pass between the source and sensor, thereby blocking the passage of light between the two, in the event that the actuating arm 15 is caused to rotate against the biasing action of the spring. The position adopted by the actuating arm 15 when the rear end of its finger 16 passes between the light source 32 and the sensor 33 represents the second position of the actuating arm 15.

As can be seen most clearly from FIG. 5, the rear feed wall 6 carries a pair of wedge-shaped projections 34, each of which extends inwardly into the feed slot 3 from the front surface of the rear feed wall 6 so as to taper in a narrowing manner and converge smoothly with the front surface of the rear feed wall 6 at their lowermost ends. Each wedge-shaped projection 34 is positioned on a respective side of the vertical slot 22 through which the forwardmost part of the actuating arm projects. As shown particularly clearly in FIG. 4, the downwardly-depending projection 19 of the actuating arm projects slightly further into the feed slot 3 than even the widest part of the two wedge-shaped projections 34, so that the front bearing surface 20 of the actuating arm extends past the wedge-shaped projections 34.

Returning again to FIG. 5, it will be seen that a further pair of projections, this time in the form of slightly larger ribs 35, extend into the feed slot 3 from the rear facing surface of the forwardmost feed wall 5. The two ribs 35 present rearwardly-directed linear faces 36 which are arranged so as to be generally parallel with, but spaced apart from, the forwardly-directed sloping surfaces of the wedge projections 34. In this manner, a space is defined between the wedge projections 34 and the ribs 35 for the insertion of a stack of paper sheets or the like to be shredded by the machine.

The actuating arm 15 is arranged relative to the feed slot 3 such that the spacing between the forwardmost bearing surface 20 of the actuating arm and the rearwardly-directed surfaces of the ribs 35 is slightly less than the maximum thickness of paper which the shredding mechanism located below the slot can comfortably shred without risking damage to the mechanism or causing the mechanism to jam.

Although not essential to the operation of the present invention, it will be seen from the accompanying drawings that the shredding machine is also provided with a pair of photo-sensors, indicated generally at 38 and 39 in FIG. 2, which are arranged on either side of the actuating arm 15 so as to direct a beam of light such as Infra-red light across the feed slot from one side and detect its arrival on the other side. In the arrangement illustrated, the first photo-sensor 38 is arranged so as to be operative across the feed slot at a level below the vertical slot 22 through which the actuating arm projects into the feed slot 3. The other photo-sensor 39 is arranged so as to be operative across the feed slot at a level above the vertical slot 22 through which the actuating arm projects into the feed slot. The function of the two photo-sensors 38, 39 can be varied at the manufacturing stage of the paper shredder, depending upon the desired functionality of the shredder. In one proposed arrangement, the higher level photo-sensor 39 is arranged so as to simply detect the presence of paper in the feed slot, whilst the lower level photo-sensor is configured to energise the electric motor 9 and hence set the cutting mechanism in motion as the leading edge of a sheet of paper or stack of papers passes the photo sensor, and to detect the passage of the trailing edge of the sheet or stack upon shredding, and to stop the electric motor after a predetermined passage of time has elapsed following movement of the trailing edge past the sensor. However, it is the function of the actuating arm 15 which is of relevance to the present invention.

If a stack of paper sheets or the like is inserted into the feed slot so as to pass between the wedge projections 34 and the ribs 35, and that stack of papers has a thickness less than the predetermined spacing between the ribs 35 and the bearing surface 20 of the actuating arm, then the sheets can be passed freely through the slot for engagement by the cutting mechanism therebelow, the cutting mechanism being switched on and off in response to signals from the lower level photo-sensor 38. However, should a stack of papers be inserted into the feed slot which has a thickness greater than the predetermined thickness defined by the spacing between the ribs 35 and the front bearing surface 20 of the actuating arm 15, then the rearmost sheet in the stack will bear against the bearing surface 20 of the actuating arm, thereby urging the actuating arm to move against the bias imposed by the spring 28, thereby pivotally moving the actuating arm 15 from its first position in which the rearmost end of the finger 16 is clear from the photo-switch 31, to its second position in which the finger 16 passes between the light source 32 and the sensor 33 of the photo-switch 31. When this happens, the beam of light passing between the light source 32 and the sensor 33 is cut and this is effective to actuate the switch 31, which is arranged to break the electrical circuit providing power to the motor 9, thereby preventing energisation of the motor 9. This prevents operation of the cutting mechanism located below the feed slot, even when the leading edge of the stack passes the lower level photo-sensor 38 which would, if the actuating arm 15 remained in its first position, trigger operation of the cutting mechanism.

The movement of the actuating arm 15 thus serves as a safety feature by preventing energisation of the cutting mechanism in the event that a user of the shredding machine attempts to insert a stack of papers of a thickness too great for the cutting mechanism to cope with. Providing papers are inserted into the feed slot in stacks having a thickness sufficiently narrow to prevent movement of the actuating arm 15 from its first position to its second position, then the shredding machine will operate normally.

It has been found through experimentation that the provision of an actuating arm 15 in the elongate form described above, whereby it is arranged for pivotal movement about an axis arranged relatively close to and generally adjacent the feed slot 3, and has a rearwardly-directing finger 16 extending a relatively large distance away from the feed slot, provides a significant degree of sensitivity to the arrangement because it allows for only a very small degree of movement of the downwardly-depending projection 19 to be amplified into a larger degree of movement at the rearmost end of the finger 16 which serves to actuate the photo-switch 31. This means that by careful arrangement of the length of the arm and the spring constant of the biasing spring 28, sufficient sensitivity can be imparted to the arrangement to detect the insertion of a stack of papers which might perhaps have only one or two sheets in excess of the maximum number which can be safely shredded by the shredding mechanism.

Figure 6:
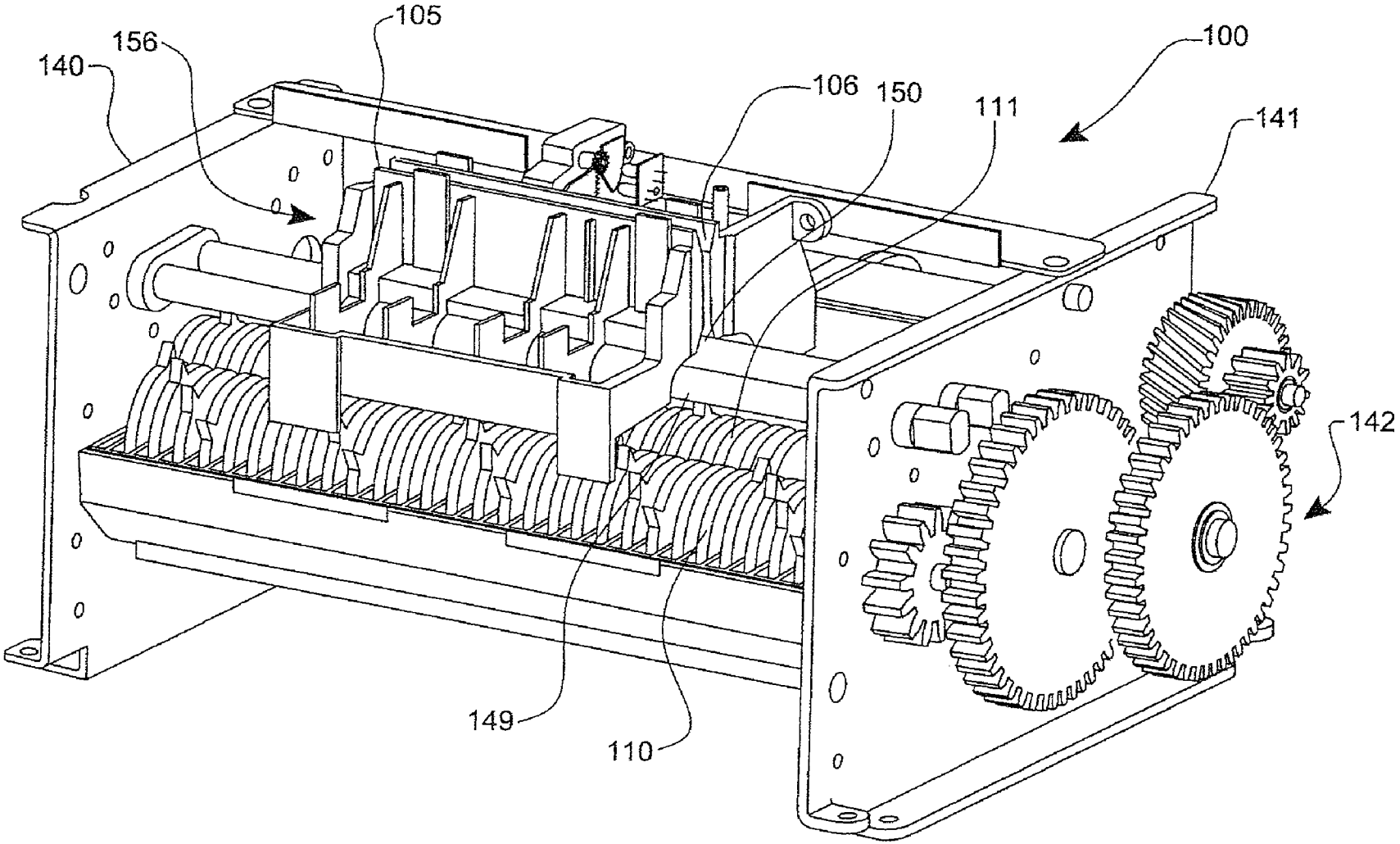
FIG. 6 is a three-quarter perspective view of an alternative mechanism which may be provided inside a shredding machine in accordance with the present invention.
Figure 7:
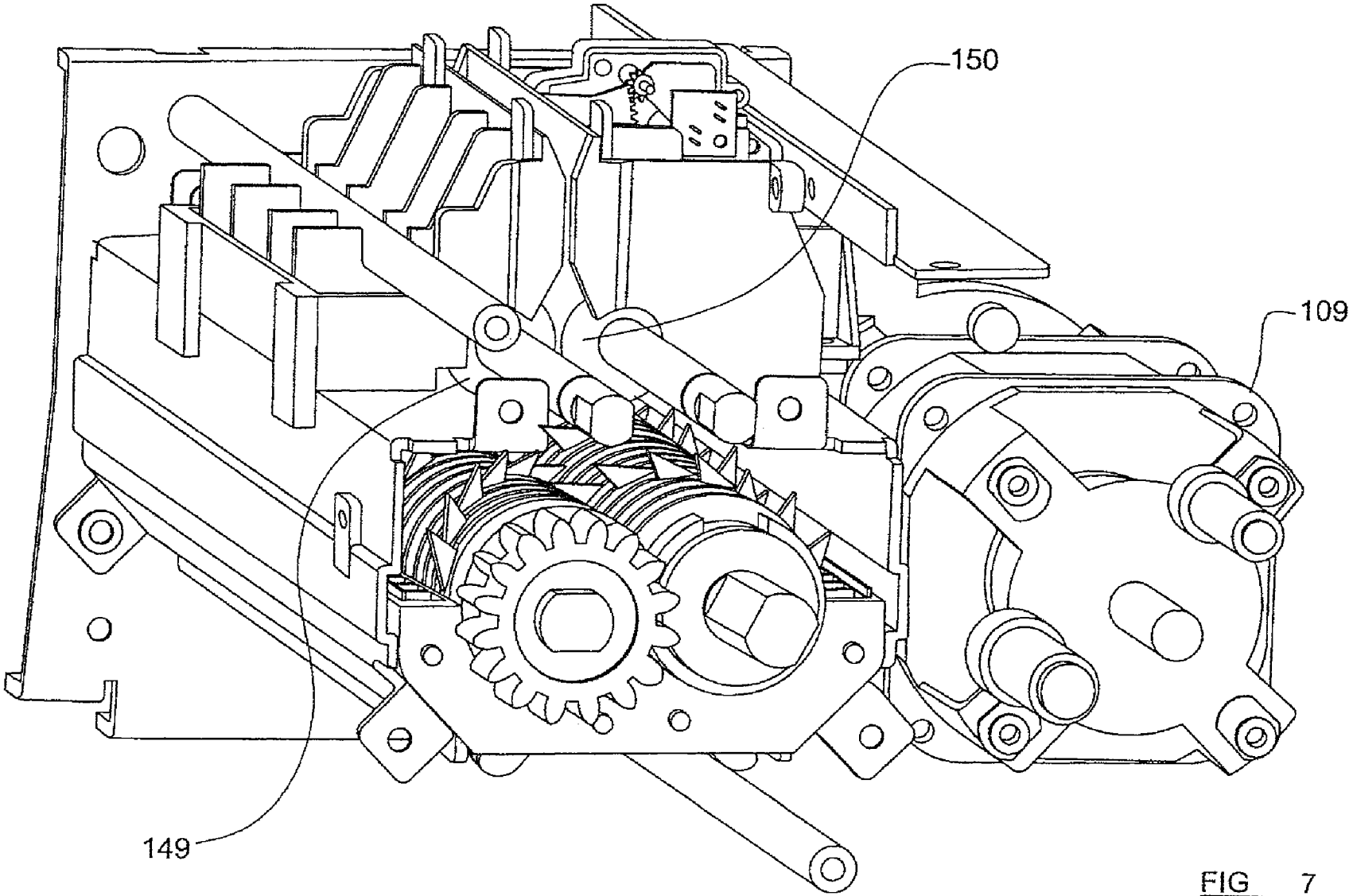
FIG. 7 is a perspective view from the side of the mechanism shown in FIG. 6, with certain components in the mechanism removed to aid understanding of the mechanism.

Referring now to FIGS. 6 and 7, these figures show the principal features of a mechanism or "inner workings" of a shredding machine according to a further embodiment of the present invention.

Setting aside merely aesthetic differences, the mechanism 100 shown in FIGS. 6 and 7 bears many similarities to the inner workings illustrated in FIGS. 2 and 3. Thus, there is provided a pair of substantially parallel upstanding feed walls 105, 106 similar to feed walls 5, 6 (see FIG. 3), which form part of a guide housing assembly 157. A pair of elongate rotatable cutters 110, 110 are provided in similar manner to the elongate rotatable cutters 10, 11 (see FIG. 3), which are again arranged for counter-rotation relative to one another, in a region below the feed walls 106, 106, for shredding sheet material fed downwardly between the feed walls 105, 106.

The cutters 110, 111 extend between a pair of opposing mounting brackets 140, 141 and are driven by a motor 109 (as best seen in FIG. 7, where the mounting bracket 141 has been removed for a better view of the mechanism) via a series of gears indicated generally at 142.

Figure 8:
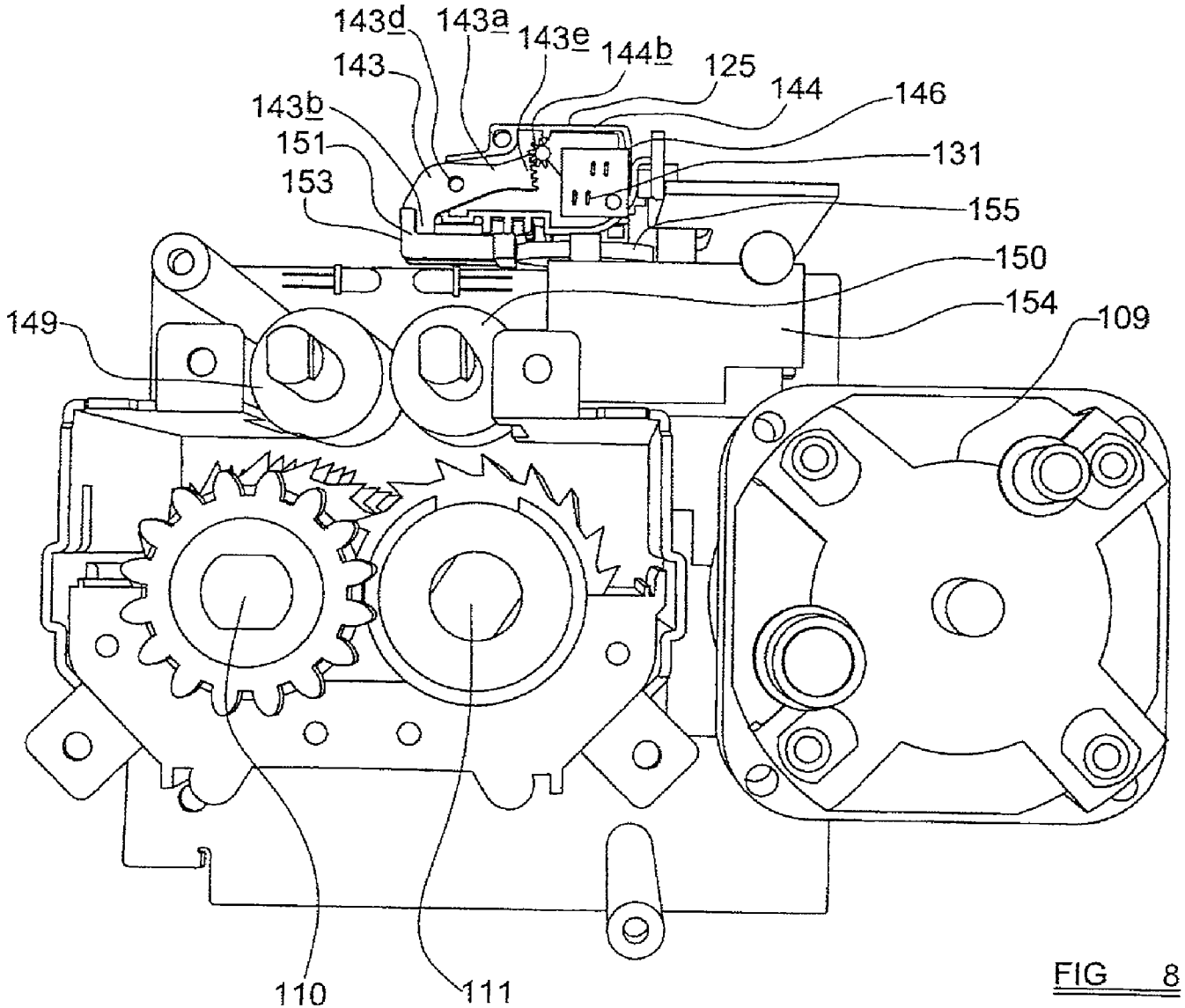
FIG. 8 is a side view corresponding to FIG. 7, showing the mechanism with further parts removed to illustrate further aspects of the mechanism.

In similar manner to the embodiment illustrated in FIGS. 2 and 3, an actuating element is provided in the region of the upper edge of the feed walls 105, 106. However, in contrast to the embodiment shown in FIGS. 1 and 2, the actuating element is not provided in the form of an elongate actuating arm, but is instead provided in the form of a pair of arm members 143, 144, as best shown in FIGS. 8 and 9 (the guide housing assembly 157 having been omitted from FIG. 8).

Figure 9:
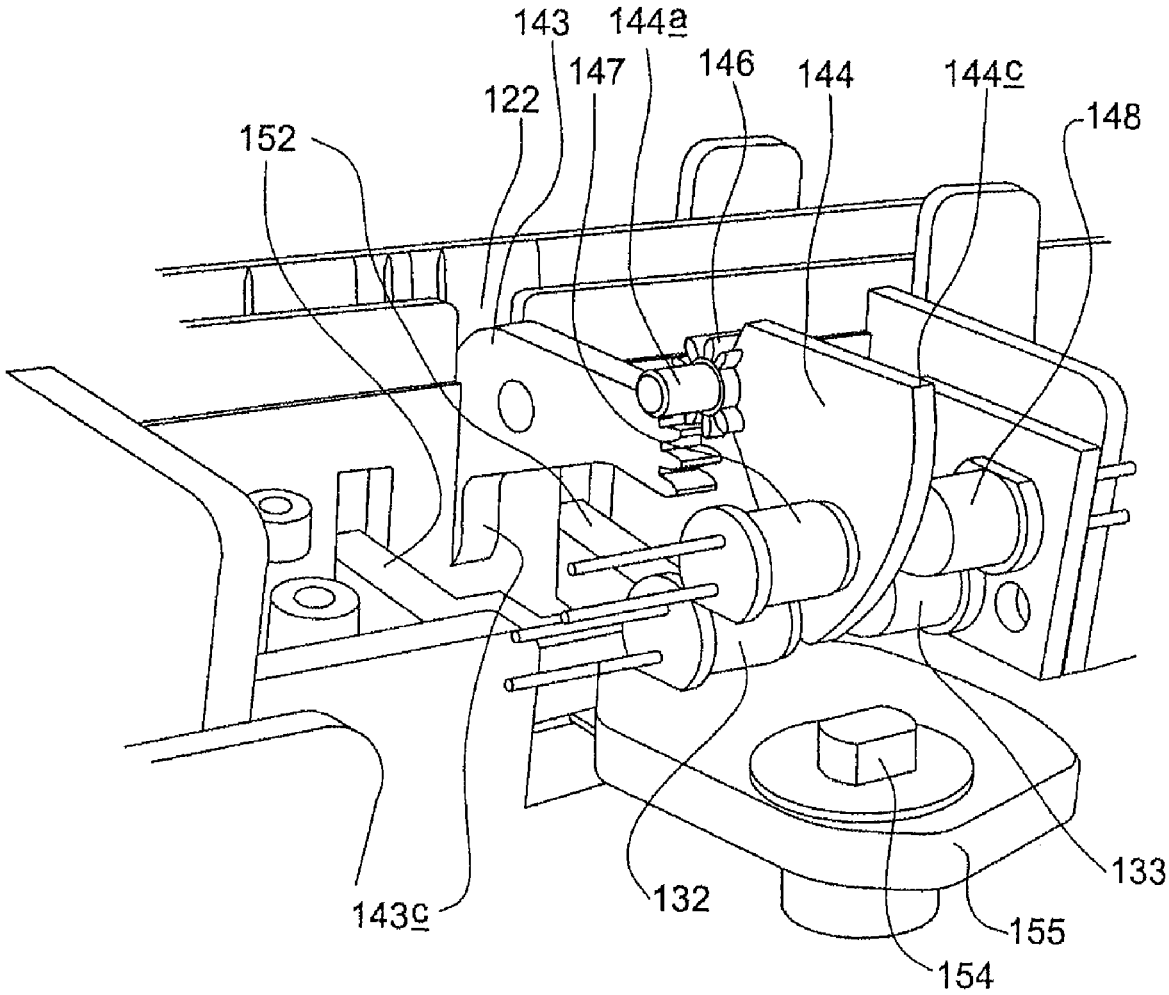
FIG. 9 is an enlarged rear perspective view of part of the mechanism shown in FIGS. 6 to 8, again with certain components removed for ease of illustration and understanding of the mechanism.

Referring principally to FIG. 9, the arm member 143 shares a number of features in common with the elongate arm 15 of the previous embodiment. Thus, the arm 143 comprises a rear finger portion 143*a*, supporting a forwardly and downwardly extending front finger portion 143*b*, the latter carrying a downwardly depending projection 143*c*. The projection 143*c* is accommodated within a vertically oriented slot 122 such that the projection 143*c* projects partially into the space defined by the two feed walls 105, 106. Likewise, the arm member 143 is pivotally mounted to a support plate 125 comprising a spigot (not shown) which extends into a bearing aperture 143*d* in the arm member 143.

However, in contrast to the arm 15 of the previous embodiment, the rear finger portion 143*a* of the arm member 143 is relatively short and terminates in an arcuate gear portion 143*e* centred on the pivot-axis of the arm member 143.

The arm member 144 is also pivotally mounted within the support housing 125, by means of outwardly directed spigots 144*a* (only one of which is visible in FIGS. 8 and 9) rotatably received within respective bearings within the support housing 125. The arm member 144 comprises a respective gear portion 144*b* centred on the spigots 144*a* (and hence the pivot-axis of the arm 144) which engages with the gear portion 143*e* of the arm member 143. The arm member 144 further comprises a rearwardly extending circular segment 144*c*, being a segment of a circle centred on the pivot point.

It will be appreciated, referring to FIG. 8, that the arm members 143 and 144 are operably connected to one another by means of an intermediate gear arrangement (in this case, comprised of the gear portion 143*e* and gear portion 144*b*), whereby rotation of the arm member 143 in an anti-clockwise sense about its pivot axis will produce a corresponding rotation of the arm member 144 in a clockwise sense about its pivot axis, with the degree of rotation of the arm member 144, relative to the arm member 143, being determined by the gear ratio of the rack portion 143*e* and pinion portion 144*b*.

The arm member 143 is biased clockwise under the action of a spring (not shown), and the arm member 144 is thus effectively biased anti-clockwise under the action of the spring (via arm member 143). The actuating element is therefore collectively biased towards a first position, in which the arm member 143 projects into the space between the feed walls 105, 106.

As best illustrated in FIG. 8, the shredding machine mechanism 100 is provided with a switch 131. The switch 131 takes the form of a photo switch having a light source 132 and a photo sensor 133 (each being illustrated schematically in FIG. 9). The light source 132 and photo sensor 133 are provided in spaced apart relation in similar manner to the light source 32 and photo sensor 33 of the previous embodiment, except that they are actually positioned below the rear end of the arm member 144 when the arm member 143 assumes its first position under the biasing action of the spring. Thus, the rear most end of the arm member 144 may pass between the source 132 and sensor 133, thereby blocking the passage of light between the two, in the event of sufficient rotation of the arm member 143 against the biasing action of the spring. The positions adopted by the arm member 143 and arm member 144 when the rear end of the arm member 144 passes between the light source 132 and the sensor 133 collectively represent the second position of the actuating element.

In addition, a second switch 146 is provided at a position above the switch 131. The switch 146 is in the form of a photo switch, similar to the switch 131, comprising a light source 147 and a photo sensor 148 mounted in spaced apart relation from one another to allow the rear end of the arm 143 to pass therebetween, thereby blocking the passage of light between the light source 147 and sensor 148, in the event that the arm member 143 is sufficiently rotated against the biasing action of the spring. The position adopted by both the arm member 143 and arm member 144 when the rear end of the arm member 144 passes between the light source 147 and sensor 148 collectively represents an intermediate position of the actuating element, between the first and second positions. The switch 146 is in the form of a "timer-switch", the operation of which will be described in more detail below.

Referring again now to FIGS. 6, 7 and 8, the mechanism 100 is further provided with a pair of rollers 149, 150 which are rotatably mounted between the mounting brackets 140 and 141 and which are operably connected to the motor 109 by means of a series of gears (not shown).

As will best be appreciated from FIG. 8, the rollers 149, 150 are mounted directly above the respective cutters 110, 111 such that the rollers are positioned in between the feed walls 105, 106 (and hence the feed aperture) and the cutters 110, 111 (forming the cutting mechanism). In this manner, sheets being directed towards the cutting mechanism will necessarily pass between the rollers, upstream of the cutting mechanism, as described in more detail below.

Still referring primarily to FIG. 8, the mechanism 100 is further provided with a sheet material engaging member in the form of a trigger plate 151 having a generally L-shaped cross-section and comprising a pair of prong portions 152 (best shown in FIG. 9), each prong portion 152 terminating in an upwardly extending pressing portion 153 (best shown in FIG. 8). The trigger plate 151 is mounted for sliding lateral movement (generally perpendicular to the plane of sheet material being fed between the feed walls) within the guide assembly housing (as best shown in FIG. 9), whereby the trigger plate 151 may move between an advanced position, shown in FIG. 8, in which the trigger plate 151 extends to a position in line with the downwardly depending projection 143*b* of the arm 143, and a retracted position (not shown), in which the downwardly directed projection 143*b* protrudes laterally beyond the trigger plate 151 into the space between the feed walls 105, 106.

The trigger plate 151 is biased towards the retracted position by a suitable spring (not shown), and is moved to the advanced position, against the bias of the spring by means of a motor 154, which is operably connected to the trigger plate via a cam member 155 (FIG. 9) mounted to the shaft 154*a* of the motor 154

Energisation of the motor 154 (insofar as it is allowed by the actuating element) may be triggered in the same manner as energisation of the primary motor 109, for example using a pair of photo sensors such as the photo sensors 38 and 39 described in connection with the previous embodiment. Again, this specific form of trigger mechanism is not essential to the operation of the present invention, provided there is some means for energising the motor 154 in response to a stack of sheet material (of suitable thickness) being fed into the shredding machine.

It is to be appreciated that the mechanism 100 may be mounted within a shredding machine, such as an office shredder, essentially in the same manner as the "inner workings" of the previous embodiment Thus, the mechanism 100 may simply be mounted onto a large plastic container or bin, and a housing may then be positioned over the mechanism 100 in similar manner to the previous embodiment described.

If a stack of paper sheets or the like is inserted into the feed slot of a shredding machine containing the mechanism 100, and that stack of papers has a thickness less than the predetermined spacing between the forward most surface of the arm member 143 and the opposite feed wall 105, then the sheets can be passed freely through the slot without those sheets bearing against the arm 143 so as to rotate the arm 143 against the bias of the spring. In this case, the sheets can be passed freely through the slot for eventual engagement by the cutting mechanism in similar manner to the previous embodiment. However, in contrast to the previous embodiment, as the leading edge of the stack of papers passes between the photo sensor 156, the secondary motor 154 will be energised, which will in turn rotate the cam member 155 on the motor shaft 154 so as to advance the trigger plate 151 laterally towards the advanced position. In this manner, the trigger plate will eventually engage and press against the sheet material so as to prevent any excessive movement of the sheet material towards the arm 143, for example as a result of "waving" of the sheet material as might otherwise occur (particularly once the leading edge of the sheet material has engaged the cutters 110, 111 below).

It will also be appreciated, referring in particular to FIG. 8, that as the stack of papers is fed downwardly through the feed slot of the shredding machine, it will pass between the rollers 149, 150, prior to engaging the cutters 110, 111, so that the rollers 149, 150 will engage the sheet material at a point upstream of the cutters 110, 111. In this manner, the rollers 149, 150 will also tend to prevent the sheet material from inadvertently exceeding the predetermined threshold thickness subsequent to the sheet material having been passed successfully between the forward most surface of the arm 143 and the opposing feed wall 105, again as might otherwise occur if the sheet material were to start "waving" or flapping, particularly as it is being cut by the cutters 110, 111.

In the case where, despite the rollers 149, 150 and the trigger plate 151, "waving" or flapping of the sheet material occurs (or in the case where the mechanism does not include the rollers 149, 150 and trigger plate 151), the degree of "waving" or flapping may be such as to unacceptably increase the effective thickness of the sheet material beyond a predetermined intermediate thickness threshold thickness, whereby the sheet material will engage the arm member 143 so as to pivot the arm member 143 and consequently move the rear portion of the arm member 144 so that it obstructs the passage of light between the light source 147 and light sensor 143. In this position (the intermediate position of the actuating element) the timer switch 146 will be actuated. Once actuated, the timer switch 146 will operate to cut power to the primary motor 109 (driving the cutting mechanism), after a predetermined period of time, unless the arm 144 is subsequently rotated back to a position whereby it no longer blocks the light source 147, during that predetermined period of time period. In the latter case, the photo switch 146 will instead be deactivated and cutting may continue in the normal manner.

Thus, the timer switch 146 (and the actuating element) allow the thickness of the sheet material to exceed a predetermined intermediate threshold thickness for a certain predetermined period of time (chosen to correspond to the period of time which the mechanism 100 can tolerate such a thickness of sheet material), but unless the thickness of the sheet material is reduced within this time period, then the power to the motor 109 will be cut. The timer switch 146 thus reduces the risk of a jam occurring due to "waving" or flapping of the sheet material, whilst nevertheless tolerating a certain degree of such "waving" or flapping, within acceptable limits and for an acceptable period of time.

On the other hand, should a stack of papers be inserted into the feed slot having a thickness which sufficiently exceeds a predetermined maximum threshold thickness (above the intermediate threshold thickness), the arm member 143 will be rotated, against the bias of the spring, so as to consequently move the rear portion of the arm member 144 sufficiently to block the passage of light between the light source 132 and photo sensor 133. The actuating element thus adopts the second position and, in this case, the photo switch 131 is activated and the electrical circuit providing power to the motor 9 is broken, thereby preventing energisation of the motor 9 almost immediately, in a similar manner to the previously described embodiment.

Of course, if the initial (inherent) thickness of the sheet material exceeds the intermediate threshold thickness, but not the maximum thickness threshold, so that the actuating element adopts an intermediate position (with the arm member 144 positioned between the light source 147 and sensor 148) then the motor 109 will be energised initially, but will then be cut off by the timer switch in the manner described above.

It will be appreciated that by selecting an appropriate gear ratio for the intermediate gear arrangement between arm member 143 and arm member 144, one can vary the sensitivity of the actuating element without having to increase the length of either the arm member 143 or arm member 144. In this manner, the required sensitivity can be achieved whilst using a relatively compact actuating element, Whilst the present invention has been described above with reference to a specific embodiment, certain modifications could be made to the arrangement described above without departing from the scope of the invention as defined by the appended claims. For example, it is envisaged that in variants of the invention, the above-described photo switch 31 could be replaced by some other convenient form of switch such as, for example, a micro switch arranged to be actuated by contact with the rear end of the finger 16 of the actuating arm.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A shredding machine for shredding sheet material, the machine comprising a feed-aperture and an electric cutting mechanism, the feed-aperture being configured to receive multiple sheets and direct said sheets towards the cutting mechanism for shredding, the machine being characterised by the provision of an actuating element which is moveable between a first position in which the actuating element permits energisation of the cutting mechanism and a second position in which the actuating element prevents energisation of the cutting mechanism, wherein part of the actuating element extends into the feed-aperture through an opening in a wall that at least partially defines the feed-aperture, the actuating element being configured such that said part will be engaged by sheet material inserted into the feed-aperture, and moved from said first position to said second positioned as a result of said engagement, if the sheet material exceeds a predetermined thickness, wherein the actuating element is configured for movement to an intermediate position, between said first and second positions, if engaged by sheet material exceeding a predetermined intermediate threshold thickness, wherein in the intermediate position the actuating element only permits energisation of the motor for a predetermined time period.

2. A shredding machine according to claim 1, wherein said actuating element is biased towards said first position.

3. A shredding machine according to claim 2, wherein said bias is provided by a spring.

4. A shredding machine according to claim 1, wherein said actuating element is arranged to actuate a switch when in said second position, the switch being configured to cause a break in the circuit providing power to the cutting mechanism.

5. A shredding machine according to claim 4, wherein said switch comprises a non-contact sensing means.

6. A shredding machine according to claim 4, wherein said switch is a photo-switch.

7. A shredding machine according to claim 4, wherein said switch is a micro-switch.

8. A shredding machine according to claim 1, wherein the actuating element is arranged to actuate a timer-switch such that, if the actuating element remains in the intermediate position longer than said predetermined time period, the switch causes a break in the circuit providing power to the cutting mechanism.

9. A shredding machine according to claim 8, wherein said switch comprises a non-contact sensing means.

10. A shredding machine according to claim 8, wherein said switch is a photo-switch.

11. A shredding machine according to claim 8, wherein said switch is a micro-switch.

12. A shredding machine according to claim 1, wherein the actuating element is in the form of a pair of pivotally mounted arm members, the arm members being operably connected to one another by an intermediate gear arrangement for movement of the actuating element between said first and second position.

13. A shredding machine according to claim 1, wherein said actuating element is provided in the form of an elongate arm mounted for pivotal movement between said first and second positions.

14. A shredding machine according to claim 13, wherein said actuating element is arranged to actuate a switch when in said second position, the switch being configured to cause a break in the circuit providing power to the cutting mechanism, and wherein the extent of the arm extending from the pivot axis of the arm into the feed-aperture is less than the extent of the arm extending from the pivot axis to the switch.

15. A shredding machine according to claim 13, wherein the pivot axis is located substantially adjacent the feed-aperture.

16. A shredding machine according to claim 14, wherein said switch is located remote from said pivot axis.

17. A shredding machine according to claim 1, wherein said predetermined thickness is less than or equal to the maximum thickness of sheet material which can be shredded by the cutting mechanism without the mechanism becoming jammed.

18. A shredding machine according to claim 1, further provided with indicating means to provide a visual indication to a user of the machine that energisation of the cutting mechanism is prevented, when the actuating element is in said second position.

19. A shredding machine according to claim 1, wherein the shedding machine comprises at least one pair of rollers positioned in between the feed-aperture and the cutting mechanism such that sheets being directed towards the cutting mechanism pass between the rollers, upstream of the cutting mechanism.

20. A shredding machine according to claim 19, wherein a pair of said rollers is located adjacent the feed-aperture.

21. A shredding machine according to claim 1, wherein the machine is further provided with a sheet-material engaging member positioned downstream of the actuating element, the engaging member being operable to engage and press against the sheet material for preventing the sheet material from subsequently exceeding said predetermined intermediate thickness, downstream of the actuating element.

22. A shredding machine according to claim 21, wherein the engaging member is in the form of a motor-driven trigger plate for pressing against the sheet material, the trigger plate being operably connected to the respective motor by means of a cam member for advancing the trigger plate towards the sheet material along a direction generally perpendicular to the plane of the sheet material.

23. A shredding machine according to claim 1, wherein the feed-aperture has a length sufficient to accommodate sheets to be shredded by the machine, the part of the actuating element that extends into the feed-aperture being substantially narrower than the length of the feed-aperture in the lengthwise direction of the feed-aperture, 24. A shredding machine according to claim 1, wherein the opening is a vertical slot.

25. A shredding machine for shredding sheet material, the machine comprising a feed-aperture and an electric cutting mechanism, the feed-aperture being configured to receive multiple sheets and direct said sheets towards the cutting mechanism for shredding, the machine being characterised by the provision of an actuating element which is moveable between a first position in which the actuating element permits energisation of the cutting mechanism and a second position in which the actuating element prevents energisation of the cutting mechanism, wherein part of the actuating element extends into the feed-aperture through an opening in a wall that at least partially defines the feed-aperture, the actuating element being configured such that said part will be engaged by sheet material inserted into the feed-aperture, and moved from said first position to said second positioned as a result of said engagement, if the sheet material exceeds a predetermined thickness, wherein the machine is further provided with a sheet-material engaging member positioned downstream of the actuating element, the engaging member being operable to engage and press against the sheet material for preventing the sheet material from subsequently exceeding said predetermined thickness, downstream of the actuating element.

26. A shredding machine according to claim 25, wherein the engaging member is in the form of a motor-driven trigger plate for pressing against the sheet material, the trigger plate being operably connected to the respective motor by means of a cam member for advancing the trigger plate towards the sheet material along a direction generally perpendicular to the plane of the sheet material.

27. A shredding machine according to claim 1, in the form of a paper-shredder suitable for home or office use.

* * * * *

UNITED STATES PATENT AND TRADEMARK OFFICE

CERTIFICATE OF CORRECTION

PATENT NO. : 7,624,938 B2
APPLICATION NO. : 11/561022
DATED : December 1, 2009
INVENTOR(S) : Paul Arthur Aries et al.

It is certified that error appears in the above-identified patent and that said Letters Patent is hereby corrected as shown below:

Col. 11, Claim 1, line 16:

change "moved from said first position to said second positioned as a" to --moved from said first position to said second position as a--.

Signed and Sealed this

Sixteenth Day of March, 2010

David J. Kappos

David J. Kappos
*Director of the United States Patent and Trademark Office*